US010337321B1

(12) United States Patent
Sarac et al.

(10) Patent No.: US 10,337,321 B1
(45) Date of Patent: Jul. 2, 2019

(54) SYSTEM AND METHOD TO AUTOMATE DATA ACQUISITION IN A WIRELESS TELEMETRY SYSTEM

(71) Applicant: Schlumberger Technology Corporation, Sugar Land, TX (US)

(72) Inventors: Sukru Sarac, Dhahran (SA); Clement Probel, Clamart (FR); Stephane Vannuffelen, Cambridge, MA (US); Andriy Gelman, Somerville, MA (US); Arnaud Croux, Boston, MA (US); Elias Temer, Clamart (FR); Khaled Mouffok, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/843,773

(22) Filed: Dec. 15, 2017

(51) Int. Cl.
*E21B 47/14* (2006.01)

(52) U.S. Cl.
CPC ..... *E21B 47/14* (2013.01)

(58) Field of Classification Search
None
See application file for complete search history.

(56) References Cited

U.S. PATENT DOCUMENTS 6,442,105 B1 8/2002 Tubel et al.
6,985,750 B1 * 1/2006 Vicknair ..... H04W 8/20 370/310
2011/0176387 A1 7/2011 Froelich

FOREIGN PATENT DOCUMENTS

WO 2013112273 A2 8/2013
WO 2014100272 A1 6/2014

OTHER PUBLICATIONS

R.T Marler, J.S Arora, "Survey of multi-objectives optimization methods for engineering", Apr. 2004, Structural and Multidisciplinary Optimization, vol. 26, Issue 6, p. 369-395, (27 pages).
International Search Report and the Written Opinion Issued in the related PCT application PCT/US2018/064740, dated Mar. 7, 2019 (7 pages).

* cited by examiner

*Primary Examiner* — Adolf Dsouza
(74) *Attorney, Agent, or Firm* — Cameron R. Sneddon; Diana Sangalli

(57) ABSTRACT

A system and method to automate data acquisition in a wireless telemetry network optimizes data acquisition to best match a target data set that the user desires given the performance limitations of the telemetry network. The user defines the target data set by providing inputs regarding a target quality of the target data set relative to a data set that has been produced and stored by a communication node in the network. The performance limitations of the network are defined in a system operating envelope. A data acquisition cycle is then automatically initiated and propagated in the network to acquire an actual data set that is an optimal match for the user's target given the system operating envelope.

29 Claims, 6 Drawing Sheets

SYSTEM AND METHOD TO AUTOMATE DATA ACQUISITION IN A WIRELESS TELEMETRY SYSTEM

FIELD OF THE DISCLOSURE

This disclosure relates generally to hydrocarbon exploration and production and, more particularly, to acquiring data from reservoirs.

DESCRIPTION OF THE RELATED ART

Hydrocarbon fluids, including oil and natural gas, can be obtained from a subterranean geologic formation, referred to as a reservoir, by drilling a wellbore that penetrates the formation. Once a wellbore is drilled, various well completion components are installed to enable and control the production of fluids from the reservoir. Telemetry data representative of various downhole parameters, such as downhole pressure and temperature, is often monitored and must be communicated to the surface during operations before, during and after completion of the well, such as during drilling, perforating, fracturing and well testing operations. In addition, control information often is communicated from the surface to various downhole components to enable, control or modify the downhole operations.

Accurate and reliable communications between the surface and downhole components during operations can be difficult. Wired, or wireline, communication systems can be used in which electrical or optical signals are transmitted via a cable. However, the cable used to transmit the communications generally requires complex connections at pipe joints and to traverse certain downhole components, such as packers. In addition, the use of a wireline tool is an invasive technique which can interrupt production or affect other operations being performed in the wellbore. Thus, wireless communication systems can be used to overcome these issues.

An example of a wireless system is an acoustic communication system. In acoustic systems, information or messages are exchanged between downhole components and surface systems using acoustic or electromagnetic transmission mediums. As an example, a network of acoustic devices can be deployed downhole that uses tubing in the wellbore as the medium for transmitting information acoustically.

SUMMARY

The present disclosure describes a method of acquiring data in a wireless telemetry network that includes multiple wireless communication nodes, at least one of which stores a set of produced data that corresponds to measurements of a parameter of interest. The method include defining a target data set to acquire from the set of produced data, and providing a system operating envelope that define communication characteristics of the telemetry network. To acquire an actual data set from the produced data set, a data acquisition cycle is initiated. The data acquisition cycle includes execution parameters that are automatically optimized so that the actual data set is an optimal match of the target data set given the system operating envelope.

The present disclosure also describes a method of acquiring telemetry data in an acoustic communications network that includes acoustic communication nodes deployed in a wellbore. In accordance with the method, a first node gathers a downhole data set that corresponds to a measured parameter of interest. A target data set that is desired at the surface is defined, where the target data set is a subset of the downhole data set. The performance limitations of the communications network also are defined. The method further includes automatically optimizing acquisition of an actual data set from the downhole data set to transmit to the surface, where the actual data set is an optimal data set that best matches the target data set given the performance limitations of the communication network. The actual data set is then received at the surface.

The present disclosure further describes a system for acquiring telemetry data from a communication network deployed in a wellbore. The system includes a control and telemetry system located at the surface to control and monitor a downhole operation. The control and telemetry system includes a user interface. Downhole equipment is located in the wellbore to observe a parameter of interest associated with the downhole operation. The system also includes a network of communication nodes coupled to an acoustic transmission medium at locations that extend between the surface system and the downhole equipment. The network has intrinsic data throughput limitations. A first node is coupled to the downhole equipment to gather a downhole data set corresponding to the observed parameter over time. A second node includes an interface to communicate with the user interface of the surface system. The user interface accepts inputs from a user to define a target data set desired from the downhole data set and to automatically build a set of queries to optimally acquire an actual data set that best satisfies the target data set given the intrinsic data throughput limitations of the network.

BRIEF DESCRIPTION OF THE DRAWINGS

Certain embodiments are described with reference to the accompanying drawings, wherein like reference numerals denote like elements. It should be understood, however, that the accompanying drawings illustrate the various implementations described herein and are not meant to limit the scope of various technologies described herein. The drawings show and describe various embodiments.

DETAILED DESCRIPTION

Figure 1:
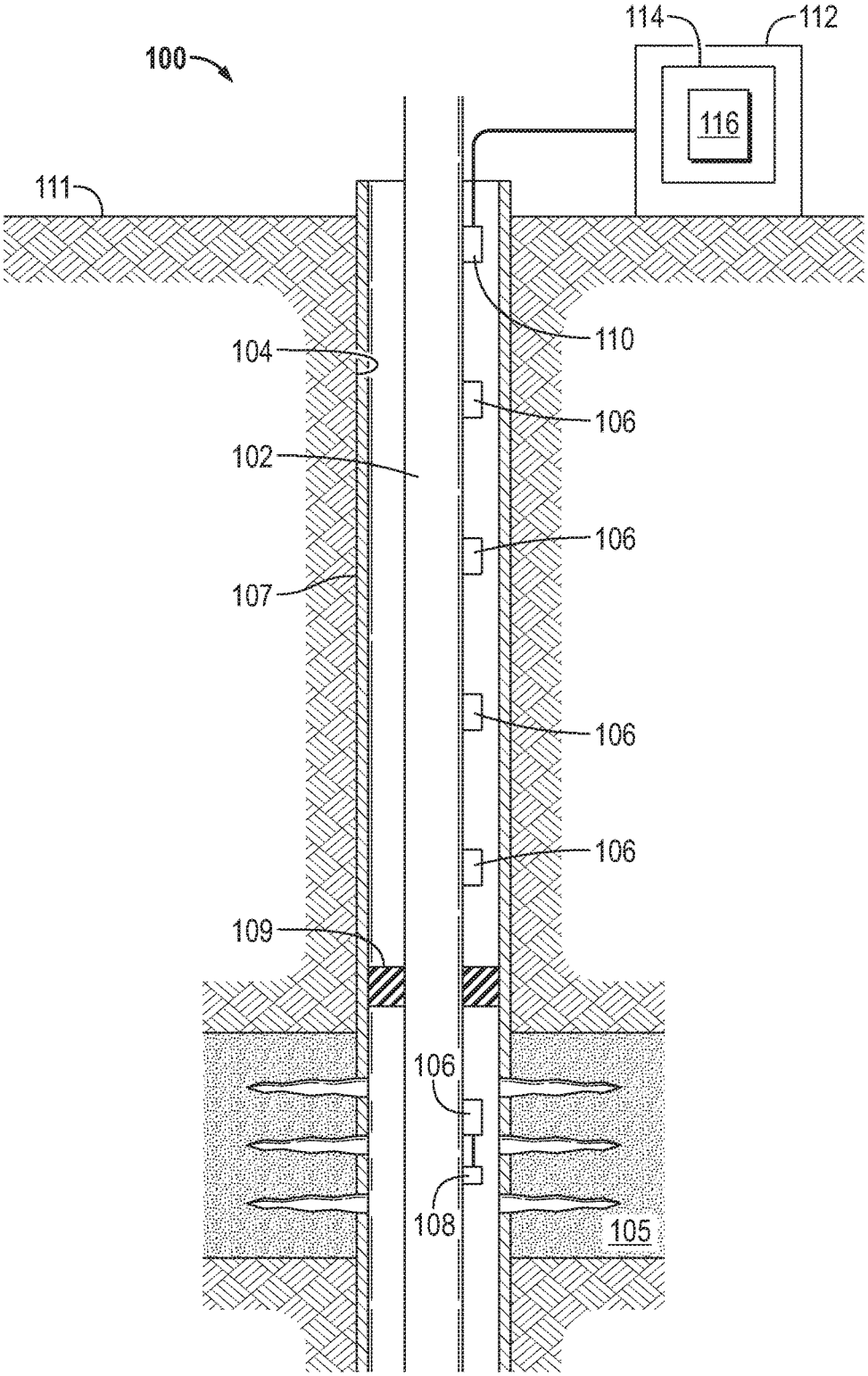
FIG. 1 is a schematic representation of a wireless telemetry network deployed in a wellbore, according to an embodiment.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention.

Wireless communication networks can be used to transmit information or messages between a control and telemetry system and various tools, sensors or other devices. When a wireless communication network is used in a hydrocarbon exploration, testing or production environment, the control and telemetry system typically is located at the surface and the tools or other devices are located downhole in a wellbore. The tools and devices are referred to as downhole equipment and can include, for example, packers, valves, chokes, firing heads, perforators, samplers, pressure gauges, temperature sensors, flow meters, fluid analyzers, etc. Messages exchanged between the surface system and the downhole equipment can be used to operate the equipment (e.g., a valve, firing head, etc.) to control the performance of a downhole operation or to monitor various downhole conditions before, during or after an operation, such as fluid flow, tool status, temperature, pressure, fluid composition, etc.

One type of wireless communications network that is widely used to exchange messages between the surface and downhole equipment is an acoustic communication network. In a downhole environment, the messages are propagated through a network using acoustic modems to transmit and receive the messages. An elastic structure in the wellbore, such as a drill string, pipe string, production tubing or casing, provides the acoustic transmission medium that carries the messages. Typically, the network is established by connecting a plurality of acoustic modems to the transmission medium (e.g., tubing) at spaced apart locations. For instance, the modems can be mounted in carriers that are attached to the tubing, although other mounting arrangements, including direct mounting arrangements, are possible and contemplated.

Each modem includes a transducer that can convert an electrical signal to an acoustic signal (or message) that is then communicated using the tubing as the transmission medium. Each modem also has a receiving system (e.g., a transducer or accelerometer) that can convert an acoustic signal to an electrical signal. Each modem has the ability to convert signals from analog form to digital form and includes a processing system to process digital data, including, for example, a microcontroller and/or a programmable gate array. Generally, an acoustic modem receives a message and processes it. If the message is locally addressed to the receiving modem, the receiving modem can manage the information (e.g., a command) carried in the message. If the receiving modem is the ultimate destination, it executes the command. Otherwise, the modem retransmits the message along the transmission medium to the next addressed modem. This process repeats so that the message continues to propagate to its ultimate destination.

In the illustrative embodiments described herein, the downhole modems can be interfaced with sensors that measure the parameters of the environment, such as temperature, pressure, flow, and fluid properties (e.g., composition, density, viscosity, etc.), as examples. Acquisition of the data measured by the sensors generally is time driven in that the sensors obtain data at either a fixed or variable rate. Historically, when telemetry was not available for communicating the data to the surface, the sensors operated in a memory mode in which the acquired data was locally stored in memory. Once the downhole operation or test was completed, the sensors were pulled out of the wellbore, and the stored data was acquired at the surface by reading the memory. The retrieved data then was processed and interpreted, either automatically or by an operator, to determine characteristics of the downhole environment, such as formation size and productivity.

With modern technology, operating sensors in memory mode has led to storage of immense amounts of data in excess of what is needed for most interpretation algorithms. As an example, a pressure sensor can be configured to acquire and store one data point per second. However, in practice, most interpretation algorithms do not require data points acquired every second and instead often are configured to perform a time decimation on the data to reduce the data set that will be interpreted. For example, if the downhole parameter of interest exhibits a logarithmic behavior, only 100 data points per log decade of time may be needed for a reliable interpretation. For a downhole job extending over a 10 day period, only about 500-600 data points will be needed if the data is sampled logarithmically over time.

Moreover, even if additional data points would be useful, acoustic telemetry systems generally have a limited communication bandwidth that is not sufficient to transmit all of the downhole data to the surface. Considering pressure data as an example, if data points are produced every second, over a million data points may be stored in the pressure sensor memory over the duration of the downhole job. However, for jobs that last about 10 days, most telemetry systems can transmit only about 10,000-50,000 data points during that time period. As such, the data that can acquired at the surface during the job is much more limited than the data that will be available at the end of the job when the sensors are pulled out of the wellbore. Thus, numerous sophisticated sampling schemes have been developed that allow for a reliable interpretation of a limited set of data that closely matches an interpretation that is performed using the entire data set. In this way, the data can be analyzed during the job while the equipment still is downhole.

However, in known systems, data acquisition is largely driven by the surface operator's actions, and the optimization of the selection of the data set for acquisition is largely dependent on the operator's experience and expectations. This can lead to situations where the data acquired is not sufficient for a particular phase of the job or it may not be matched to the then-current transmission capabilities of the network. Therefore, in the illustrative embodiments described herein, optimization of data acquisition is automated in a manner that satisfies the operator's current data acquisition needs while also taking into consideration the limitations of the communication network.

Referring now to FIG. 1, a schematic illustration of a system 100 that can be implemented in a downhole environment is shown. The system 100 includes a wireless communication network that is based on acoustics using a pipe (e.g., a production tubing 102) in a wellbore 104 as a communication channel. As shown in FIG. 1, the system 100 includes acoustic modems 106, referred to as communication nodes, that are clamped on the production tubing 102.

Each communication node 106 can receive and send acoustic messages, as was previously described above. Each node 106 can be configured differently depending on its location and role in the system 100. As an example, a node 106 can be a standalone device, or the node 106 can be interfaced with downhole equipment 108, such as a tester valve, a pressure gauge, a fluid sampler, firing head, or any other device with a digital interface. In the embodiment shown, the wellbore 104 penetrates a region of interest 105 (e.g., a hydrocarbon-producing reservoir as an example). The wellbore 104 includes a casing 107 that is perforated to allow for the flow of fluids from the region of interest 105. A packer 109 is set in the wellbore 104. One of the communication nodes 106 is located below the packer 109 to gather data from equipment 108.

The system 100 also includes a communication node 110 that is located at or near the surface 111, which is referred to as an access node. Surface 111 may be the earth surface, as shown in FIG. 1. In embodiments in which the system 100 is deployed in a subsea wellbore, surface 111 can be a platform or other structure above sea level. As shown, the access node 110 is connected to a surface system 112, such as a surface data acquisition (or telemetry) and control system. In embodiments, the surface system 112 includes a user interface 114 to provide for communications with the access node 110. The user interface 114 can also include a processing system 116 (e.g., a computer with memory) that is configured to control and monitor the downhole equipment 108 and to manage the acquisition of telemetry data measured by the equipment 108.

In general, the messages that are communicated between the nodes in the system 100 are made up of a sequence of digital bits. To transmit the bits between components, the bits are transformed into a form suitable for acoustic transmission. That is the bits are transformed so that the information can be carried on an acoustic wave that propagates along the elastic structure that serves as the acoustic transmission medium. The technique for performing the transformation is generally referred to as modulation.

However, because downhole wireless communication systems are designed to operate in the harsh environments encountered in wellbores, the systems typically are limited in terms of their data transmission capabilities. In general, data rates between nodes often is on the order of a few tens of bits per second, with the actual throughput at the surface being in the range of a few bits per second. In addition, the acoustic conditions (and signal-to-noise ratio (SNR)) vary over time and are often unpredictable. Because the capacity of the communication channel is dependent on the SNR, telemetry data rates often fluctuate during an operation.

Usually, downhole data is produced at a much faster rate than the channel capacity. For example, a single sensor can produce data at a rate of 1 sample/second, with each sample being coded on 24 bits. Consequently, when multiple sensors are used during an operation, the data production rate is far in excess of what the communication channel can handle. Thus, given the production rate of data and the varying capacity of the channel, in many cases, data produced downhole will remain stored in the downhole node's memory until the operation is complete and the equipment is pulled from the wellbore.

Accordingly, embodiments disclosed herein are directed to reducing the amount of data to send to the surface in manner that automatically matches or satisfies what the surface operator actually needs to perform an analysis. Further, because the amount of data needed at the surface can vary depending on the stage of the job, embodiments disclosed herein select a data set to send to the surface to meet the operator's needs in an adaptive manner. The data acquisition decisions that are made take into account the capabilities of the network, including capacity (or throughput) and latency, both of which can vary over time. Therefore, the embodiments disclosed herein automatically adapt data acquisition in a manner that best matches the surface operator's (or user's) current need to the communication system's current capabilities.

As would be appreciated by a person of skill in the art, the user's data needs and the communication system's capabilities are contradictory requirements. Accordingly, in embodiments that will be described in further detail below, data acquisition is automated by applying any of a variety of known (or future-developed) Multi-Objective Optimization (MOO) techniques. Although the data acquisition techniques will be described below with respect to an acoustic telemetry system, it should be understood that the systems and methods set out herein can be applied to other types of wireless communication systems.

Figure 2:
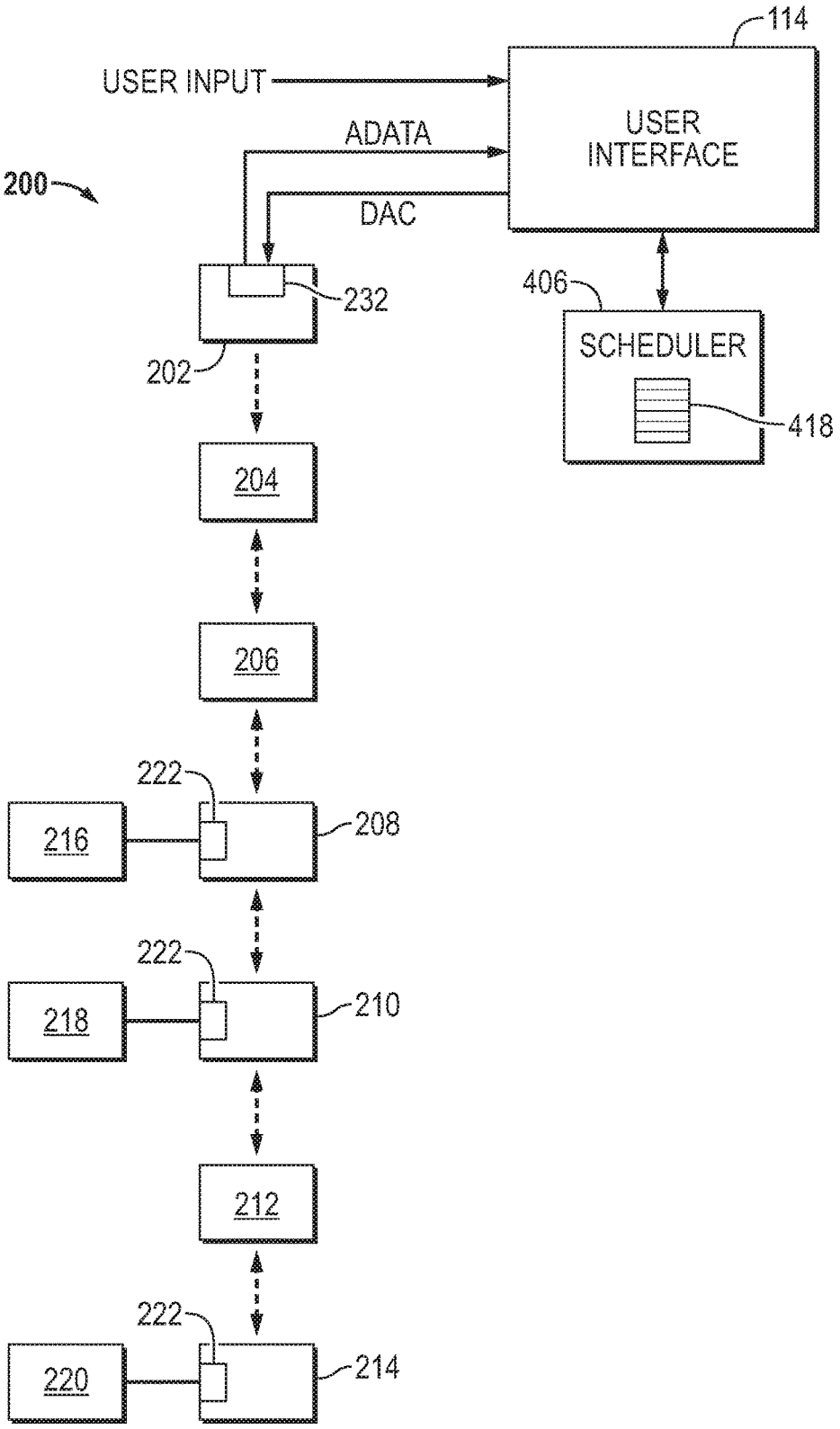
FIG. 2 is a schematic representation of a wireless telemetry network, according to an embodiment.

Referring now to FIG. 2, a schematic representation of the communication network 200 is shown. In this exemplary embodiment, the communication network 200 is a downhole telemetry system that includes multiple communication nodes 202-214 ($\{No_p\}_{p=1:P}$) that exchange messages using a defined communication protocol that is implemented on an elastic transmission medium (e.g., tubing 102 in FIG. 1). The communication nodes 208, 210, 214 interface with downhole equipment 216, 218, 220, respectively, so that these nodes produce and store data at a particular rate. These nodes will be referred to herein as "producer nodes" or "producers." Nodes 204, 206 and 212 are configured as repeaters that simply relay received messages to next nodes in the network.

Figure 3:
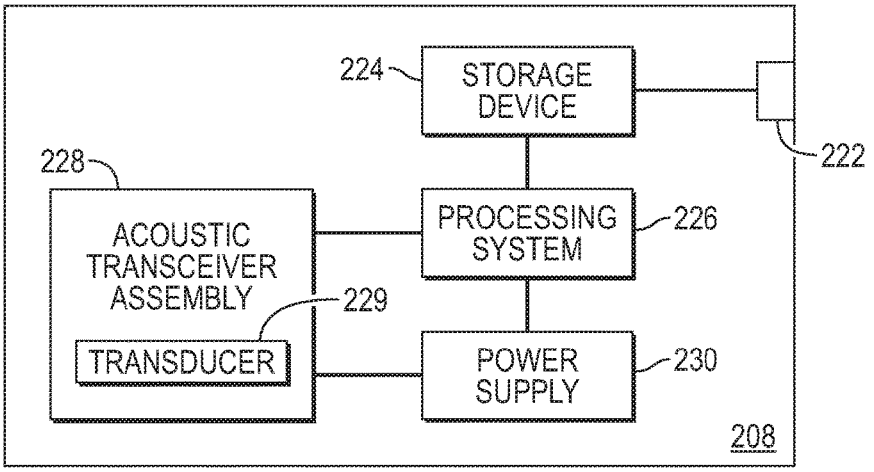
FIG. 3 is a block diagram of an exemplary wireless communication node, according to an embodiment.

A schematic representation of an example of a producer node 208 (or 210, 214) is shown in FIG. 3. As illustrated, the node 208 includes an interface 222 to connect the node 208 to the downhole equipment. The interface 222 can be a wired or a wireless interface for the exchange of digital information. The node 208 also includes a memory 224 to store data and computing instructions, a processing system 226 to perform the functions of the node 208, and a transceiver assembly 228 to send and receive acoustic messages in the network. As would be understood by a person of skill in the art, the transceiver module 228 can include appropriate circuitry and components to send and receive wireless messages, such as a receiver, demodulator, decoder, encoder, modulator, transmitter and transducer circuitry (e.g., transducer 229). The node 208 can also include a power supply 230, such as a battery, to provide power for the electronics.

Returning to FIG. 2, the uppermost node 202 includes an interface 232 so that the node 202 can communicate with the user interface 114 of the surface system 112. Node 202 will be referred to herein as an "access node."

Although only one access node, three producer nodes and three repeater nodes are shown in FIG. 2, it should be understood that the network 200 can include any number of access nodes, producer nodes and repeater nodes as may be appropriate for the particular application in which the network 200 is deployed. Further, although a particular network topology is shown in FIG. 2, the techniques disclosed herein can be applied in networks with other topologies, such as a bus, a star, a ring, a mesh, a daisy chain or any other topology or hybrid configurations.

In the embodiments described herein, data is acquired from the producer nodes through the implementation of Data Acquisition Cycles (DACs). In general, a DAC is an acquisition sequence that, when executed, targets a set of producers and then performs the data selection, the data processing and the data transmission from the producer nodes to the surface system. A DAC is executed via a sequence of messages propagated through the communication network 200 and through actions that are performed at the node level.

In the context of the embodiments disclosed herein, data acquired via a DAC is a data set that has been optimized based on the user's data acquisition needs (or requirements) and the limitations of the communication network. With reference to the block diagram of an exemplary user interface 114 shown in FIG. 4, a user defines his data acquisition requirements through a Target Acquisition Program (TAP) 400 that accepts user inputs through user interface 114. All or portions of the TAP 400 can be stored in a memory 402 associated with the user interface 114. The limitations of the network 200 are defined through a System Operating Envelope (SOE) 404. In embodiments, the SOE 404 is composed of a plurality of constraints that describe intrinsic communication characteristics of the network 200. Data representing all or portions of the SOE 404 can be stored as a table, database or other construct in memory 402. The SOE 404 can be pre-defined at the time the network 200 is set up. The SOE 404 also can be updated during or after performance of a job in the downhole environment. All or portions of the TAP 400 and SOE 404 also can be stored and/or updated at the node level, such as in memory 224 of producer node 208 as an example.

To acquire data from one or more of the producer nodes 208, 210, 214, a series of DACs are executed that are automatically initiated by the surface system 112. The DACs are configured with the goal of optimizing the actual data acquired (i.e., the data sent to the surface system) relative to the user's defined needs (i.e., the target acquisition as defined by the TAP 400) while taking into consideration the performance limitations of the network (i.e., as defined by the SOE 404). Further, as will be described in detail below, the selection of the target producer nodes, the selection of the data set for acquisition and the selection of the processing of the selected data are dynamic processes throughout the execution of the DAC that are based on decisions made at the node level with the goal of best satisfying the TAP 400 once the DAC is completed. The nodes' decisions are based on an optimization algorithm (e.g., a MOO technique) that has the goal of best satisfying the requirements defined by the TAP 400 given the limitations defined in the SOE 404.

Communication through the network 200 (e.g., message routing, media access, etc.) is managed with a dedicated communication protocol that allows point-to-point communication between communication nodes. Various types of protocols can be implemented, such as a protocol that follows the OSI (Open Systems Interconnection) model.

The data transmitted in a wireless message will generally include user or application specific data (AData) and overhead data linked to the management of the communication through the network (NData). The (NData) contains the information required to route the data through the network. In particular, it specifies the Target End Nodes $\{No_{Target}\}$ for data delivery. For example, the routing of the messages through the network can be accomplished via a routing function Route( ). The routing function is used at node level. It is used when a node $No_p$ receives a message targeting other end node(s) $\{No_{Target}\}$ and that it needs to relay through the network. In such a case, Route($No_p$;$\{No_{Target}\}$) defines the next relay node for the message to reach $\{No_{Target}\}$.

Although messages can include both AData and NData, through the remainder of this disclosure, references to "data" will refer to data produced by the nodes (or any of their transforms) that is of interest for the user. References to "data" will exclude the overhead data that otherwise is required for the management of communications through the network, unless otherwise specified.

Figure 5:
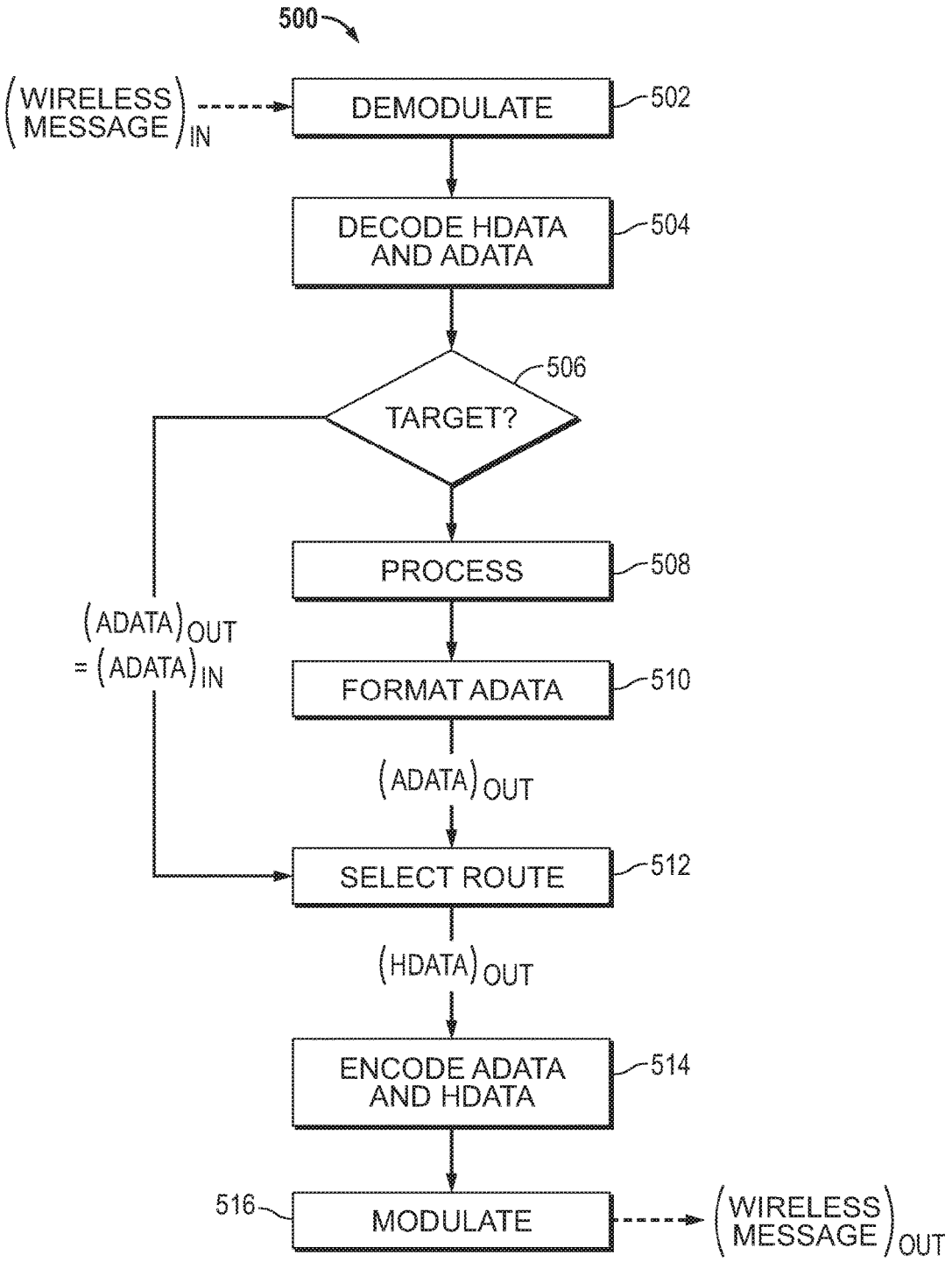
FIG. 5 is a logic diagram of operations performed by a wireless communication node, according to an embodiment.

The operation of the communication nodes 202-214 in the context of the systems and techniques described herein is shown in the example logic diagram 500 of FIG. 5. In general, a node demodulates a received wireless message (block 502), and decodes the network data $(NData)_{in}$ and the application data $(AData)_{in}$ in the demodulated message to generate Received Data (block 504). If the node is not configured as a repeater node (block 506), then the node processes the Received Data to interpret it (block 508), and performs whatever actions are required as a result of receiving and interpreting the Received Data. For example, the processing of the Received Data can result in generation of other streams of Network $(NData)_{out}$ and Application Data $(AData)_{out}$ to be forwarded to a next node, as well as identification of the next node $\{No_{Target}\}$. To forward a data stream, the node will format $(AData)_{out}$ (block 510) route and update $(NData)_{out}$ (block 512), encode the Network $(NData)_{out}$ and $(AData)_{out}$ (block 514), and then modulate a new wireless message for transmission on the transmission medium (block 516).

If the node is operating as a repeater (block 506), then the message is simply routed to a next node (block 512) with no transformation of the Application Data (AData).

As mentioned above, producer nodes (e.g., nodes 208, 210, 214) include an interface 222 to a downhole equipment 108, such as a sensor. The producer nodes also have a memory 224 to locally store data obtained from the downhole equipment 108 and to make the data available upon request.

An access node (e.g., node 202) allows a user of the system to access the network 200 to acquire data from the producer nodes. The access node 202 also can archive the data obtained from the producers. To that end, an access node 202 interfaces with user interface 114 through which the access node 202 can store, organize, process and display data that passes through the access node 202 as a result of activity in the network 200. The user interface 114 also provides a means for the user to express his needs in terms of data acquisition. The user interface 114 can be a computer or other software-driven solution that is configured to translate high level needs input by the user into a sequence of low level actions that can be implemented using the network resources of the network 200.

The low level actions correspond to a series of DACs that are initiated through the network 200 for the purpose of acquiring data from the producer nodes. In the context of the system described herein, the DAC is initiated from the surface control and telemetry system 112 and the producer nodes are located in a wellbore downhole from the surface. It should be understood, however, that the acquisition techniques and systems described herein can be implemented in other types of applications, including applications in which the network is not deployed in a wellbore.

Figure 6:
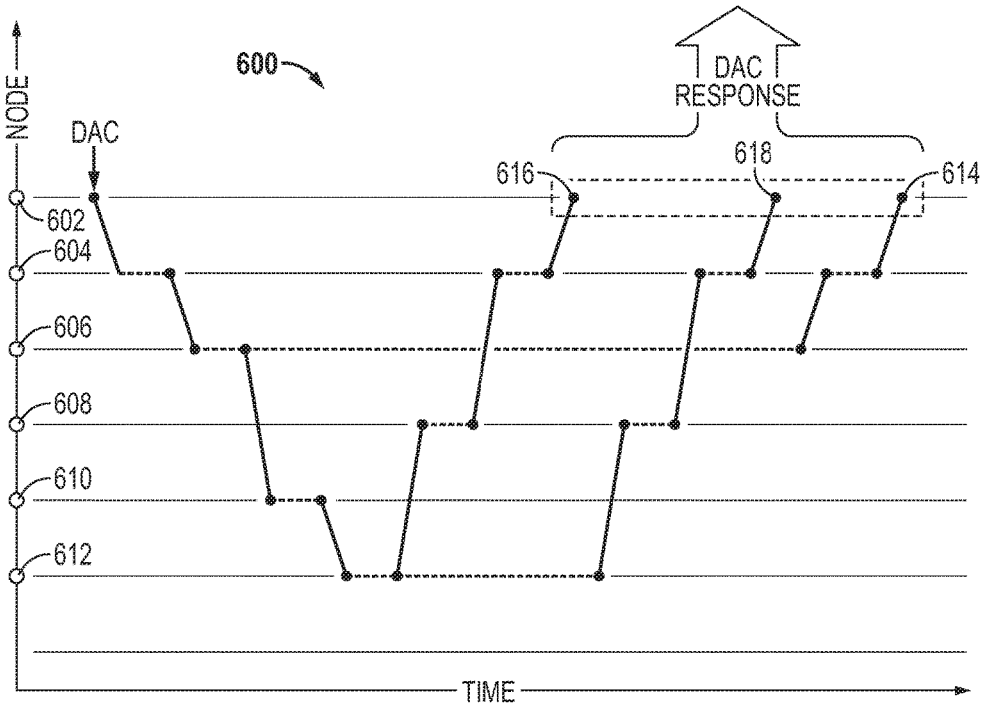
FIG. 6 is an activity diagram showing propagation of a data acquisition cycle through the telemetry network, according to an embodiment.

An exemplary representation of a DAC is shown in FIG. 6. In general, a DAC involves completing an action using network resources to relay multiple messages between nodes. A DAC can result in multiple actions generated at the node level and can potentially generate additional activity on the network. In FIG. 5, the DAC is depicted as a Node versus Time graph 600 that corresponds to an access node 602 and six downhole nodes 604, 606, 608, 610, 612, 614 interconnected by Data Transmission and Delay segments. In the graph 600, a solid dot corresponds to a transmitting node, non-solid dots correspond to a receiving node, solid lines correspond to a Data Transmission segment, and dashed lines correspond to a Delay segment. Each Data Transmission segment represents the time period during which a message is transmitted between nodes. In a DAC, the reception of a message by a node can result in the transmission of a next message to another set of nodes in the network after a certain delay. Each Delay Segment represents the delay time between the reception of a message and transmission of a next message. The delay time can be used for local data processing or to perform local action at the node, such as selecting and transforming the data to be transmitted as part of the DAC. The delay time can vary depending on the application. It may be defined by the completion of one or more actions at the node level and/or it may be determined by the availability of the communication channel.

As shown in FIG. 6, the DAC enters the network 200 through access node 602 as a wireless message that is initiated by a scheduler 406 in the surface system 112. Node 604 forwards the message to node 606 after a time delay. After a first time delay after receipt, node 606 forwards the message to node 610. After a second time delay during which the node 606 selects and processes AData for transmission, node 606 transmits a response message 614 that includes the ADdata that is targeted to the access node 602. In the embodiment shown, the response message 614 also includes an ACK to inform the access node 602 of the end of the DAC.

Node 610 forwards the message it received to node 612, which also generates response messages that are targeted to the access node 602. A first response message 616 is transmitted after a first time delay after receipt, and a second response message 618 is transmitted after a second time delay. Response messages 616 and 618 can include AData that the node 612 selected and processed for transmission to the access node 602 during the first and second time delay segments. Note that the response messages 616 and 618 are sent to node 608, which forwards the messages to node 604, which forwards the message to access node 602. The messages 614, 616, 618 collectively form the response to the DAC, which then can be sent to the surface system 112 via an acquisition front end 408 of the user interface 114.

Figure 4:
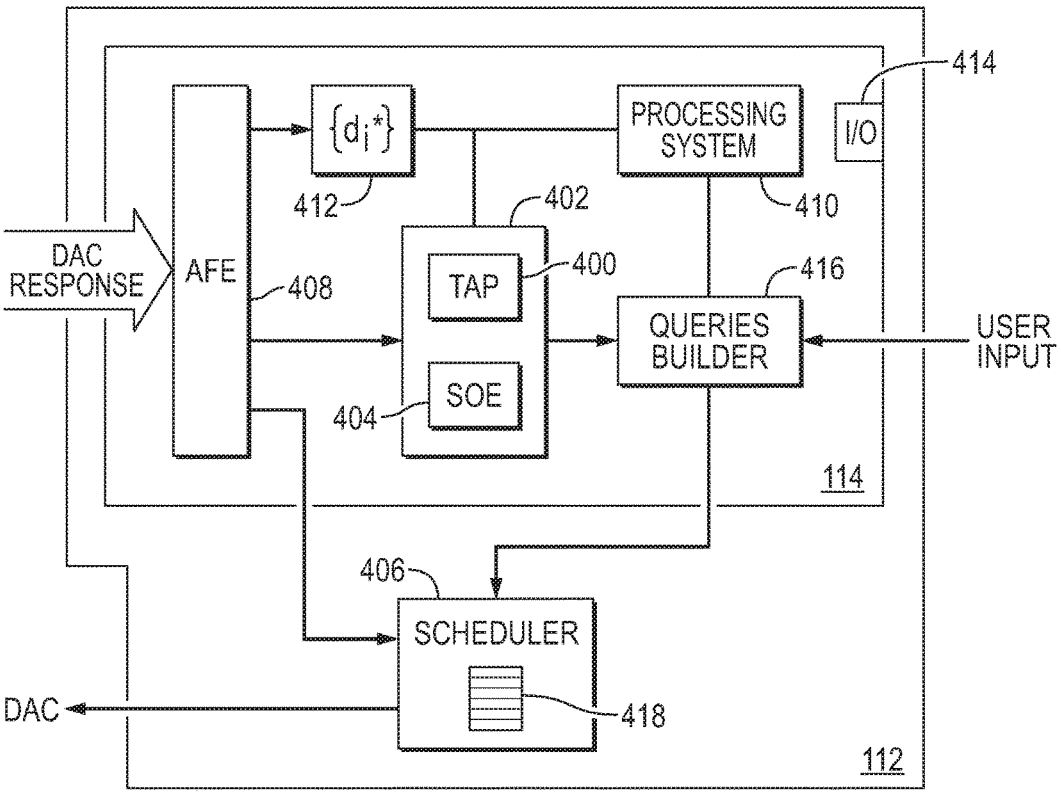
FIG. 4 is a block diagram of a surface control and telemetry system with a user interface, according to an embodiment.

From the perspective of a user of the network 200, the user gains access to the network resources through an access node, such as node 202 in FIG. 2 or node 602 in FIG. 6. As shown in FIG. 2, access node 202 communicates with the surface system 112 via user interface 114 through which the user can express his data acquisition "needs." In some implementations, to support the user needs, the user interface 114 can provide additional resources beyond the network resources. For example, as shown in FIG. 4, the user interface 114 includes processor 410 which can provide processing capability, storage devices 402, 412 to provide storage capacity to archive data or store software instructions, and one or more interfaces 414 to provide for communication with other communication systems, visualization, etc. As an example, the user interface 114 can be a computer with a processor and memory or any other type of software driven solution.

Communications in the network 200 rely on a sequence of actions implemented through a corresponding sequence of DACs. As shown in FIG. 4, the definition and management of the DACs required to satisfy the user needs is done through the TAP 400 via a Queries Builder module 416. A query should be understood as a DAC initiated on the network 200 with the specific aim of completing a task. Completion of the user needs typically requires a complex sequence of actions through the network 200. Therefore, the Queries Builder module 416 is configured to translate user needs that are expressed at a high level into a sequence of DACs. Generally, the Queries Builder module 416 will generate a sequential set of DACs to be sent through the network 200 by scheduler 406 to complete a task.

Referring still to FIG. 4, the timing to initiate a DAC depends on availability of network resources and is managed by the scheduler 406. The aim of the scheduler 406 is to manage the generation of sequences of DACs defined by the Queries Builder 416 using one or more access nodes 202 as entry points to the network 200. To that end, because the communication nodes share network resources, the communication channel may not be available all the time so that multiple DACs may not be able to share the network 200 at the same time. Thus, the scheduler 406 controls the access of the DACs to the network 200, as will be described further below. In embodiments, the Queries Builder 416 and scheduler 406 are software-driven applications that are part of the user interface 114 and/or the surface system 112. Instructions of software corresponding to the Queries Builder 416 and scheduler 406 can be stored in memory 402, 412 and executed by processor 410 of stored and/or stored and executed by another processing and memory system in the surface system 112.

As mentioned above, producer nodes produce data on a periodic basis and can store the data in the producer's memory. Each producer node "i" may produce several types of data $[D_{i,l}]$. For simplicity, the following description will refer to the data produced by each node as a single stream $D_i$. However, it should be understood that the same concepts described herein can be applied to multiple data channels from a single node.

The data produced by each channel is discrete and finite. Each data $d_{i,ui}$ produced and stored in a node is indexed and identified by an acquisition index $u_i$. The channel data set $\{d_i\}$ includes all the data already produced and ready for transmission and is stored locally in the node memory. This data set will be referred as the memory data.

It should be noted that time driven data production with a fixed production frequency is a well-known practice. Typically, in such systems, the practice for the data index $u_i$ is to increase the index by one for each new production. In other systems, a time stamp can be used instead of an index. Regardless of the mechanism, the produced data is associated with a label that allows each data point to be uniquely identified in memory.

The following notations will be used in the description that follows:

$D_i$ refers to the data channel i.

$\{d_i\}$ refers to the total data set acquired by $D_i$. (i.e., the memory data)

$\{d_i^+\}$ refers to the total data set acquired by an access node from $D_i$.

$d_{i,u_i}$ refers to the data produced by $D_i$ and indexed by $u_i$.

$\{d_{i,u_i}\}$ refers to a selected data set of memory data from $D_i$.

$\{d_{i,u_i}*\}$ refers to "acquired data," which is a data set transmitted from downhole and acquired at the surface.

The definition of successive DACs is done through the Queries Builder 416 taking into consideration the user needs (defined by the TAP 400), the network limitations (defined by the SOE 404), and the actual acquired data at the surface (defined by an Actual Acquisition Program (AAP)), as will be more fully described below. Each DAC is defined by a sequence of messages that propagate through the network in order to acquire data from the producer nodes.

The messages that are part of the DAC carry application data (AData). The AData can include, as examples, parameters linked to the execution of the DAC, data produced by the producers to be sent back to the access nodes as a result of execution of the DAC, and information that is shared between nodes.

The general processing flow that occurs at the node level upon reception of a message was described above with respect to FIG. 5. In the context of a DAC, the local processing of messages at the node level includes selecting a data set, selecting a manner in which the data set will be processed for transmission, processing the selected data set accordingly, determining the next target nodes, and transmitting the data set. This process flow will be referred to herein as a "Node Data Selection" process. The Node Data Selection process can be optimized, as will be further described below.

Initiation of a DAC depends on channel availability and is managed by the Scheduler 406. A DAC is a time-bounded process with a set of predictable completion criteria that can be evaluated by the Scheduler 406. The completion criteria are used to indicate that the DAC is completed and that the network is available for a next DAC. In an exemplary implementation, a DAC will be considered completed upon reception by the scheduler 406 of an ACK (Acknowledgement) conveyed by the last message of the DAC.

In other embodiments, the scheduler 406 can determine that the communication channel is available based on an upper estimation of the time expected to complete a DAC. In some embodiments, the scheduler 406 can also include a retry mechanism in case a communication failure is detected (e.g., an ACK is not received within the expected time frame for example). In yet other embodiments, the scheduler 406 can implement more complex mechanisms to determine channel availability. Regardless, because the process of initiating DACs is time driven and sequential, the process can be indexed. $DAC_n$ represents the $n^{th}$ DAC initiated through the scheduler 406 with n=1:N, where N corresponds to the on-going or last completed DAC.

The scheduler 406 maintains a stack 418 of DACs that have been defined by the Queries Builder 416. The Queries Builder 416 also manages priority of the stack 418. As an example, the Queries Builder 416 can implement a FIFO (First In First Out) rule. Or, the Queries Builder 416 can implement different types of priority rules so that stack management is a dynamic process in which the order of priority can be updated at any time by the Queries Builder 416.

Upon confirmation of the channel availability, the scheduler 406 can initiate a next DAC by using one of the access nodes as an entry point to the network. Initiation of the DAC can be time-based or condition-based. For example, for a time-based initiation of a DAC, the scheduler 406 can initiate the DAC in accordance with a time schedule defined by the Queries Builder 416. For a condition-based initiation, the scheduler 406 can initiate the DAC when the channel becomes available (i.e., the triggering condition) or upon occurrence of another defined event in addition to channel availability.

As disclosed above, a DAC can be represented by a tree or forest type structure, such as the structure in FIG. 6. The execution of a DAC is associated with a data flow $\{[\text{AData}]\}_{DAC}$ propagating through the network. The AData can contain transmitted data from one producer or multiple producer nodes. As shown in FIG. 6, some of the branches of the activity diagram return to the access node 602 in the form of responses 614, 616, 618 resulting from the execution of the DAC. The set of these messages will be referred as the DAC Response $[\text{AData}]_{DAC\ Response}$. The DAC Response carries the AData that will be acquired at surface as the result of the execution of the DAC.

The Target Acquisition Program (TAP) 400

The sequence of DACs takes into consideration the TAP 400, which defines the user's data acquisition requirements. The TAP 400 can be defined by the user through the user interface 114.

The TAP 400 generally can be viewed as an acquisition program composed of a series of K data acquisition segments $[S_{i,k}]_{k=1:K}$ defined for each data stream $D_i$. Each segment $S_{i,k}$ is defined by a time interval $[t_{i,k};t_{i,k+1}]$ set by the user, where i=1:l and l is the total number of target data channels. Within each time segment, the user defines the relevant parameters $\{Acq_{i,k}\}$ in terms of data acquisition. The acquisition parameters include (but are not limited to) parameters linked to the quality of the data acquired at the surface versus the data actually produced downhole. The definition of quality will depend on the user needs and how the data will be used or interpreted. The $Acq_{i,k}(\{d_i\},\{d_i^*\})$ are parameters that can be calculated from either or both the memory data $\{d_i\}$ and the acquired data $\{d_i^*\}$ from data stream $D_i$. As an illustration, possible acquisition parameters include but are not limited to, for each data stream $D_i$:

- Sampling rate ($F_{i,k}$) or sampling interval $\Delta_{i,k}$ for the data stream $D_i$.
- Data sample errors (resolution) $\Delta R_{i,k}$. This parameter defines the maximum acceptable difference between a sample acquired at surface $\{d_i^*\}$ and the actual downhole data $\{d_i\}$ in the node memory.
- Waveform reconstruction errors $MSE_{i,k}$. This parameter quantifies the overall difference between the acquired data $\{d_i^*\}$ and the downhole memory data $\{d_i\}$.
- Acquisition lag $L_{i,k}$. $L_{i,k}$ represents for each segment the lag time between the latest acquired data and the current time: $(t-t_i(t))$.
- Maximum duration of a DAC.
- Data continuity.

The TAP 400 also allows the user to specify a set of targets and constraints on the acquisition parameters $\{Acq_{k,i}\}$. The targets and constraints describe the user needs and requirements in mathematical terms that can be used for the optimization and automation of the data acquisition. To that end, each $Acq_{i,k}$ is implicitly or explicitly associated with a set of constraints reflecting the user requirements in terms of data acquisition (which is the TAP 400). It leads to the definition of a set of objective functions $C_{i,k}(Acq_{i,k})$. An objective function is a function of all or part of the acquisition parameters $Acq_{i,k}$. A possible implementation is to define one objective function for each parameter $Acq_{i,k}$, but more generally, it should be noted that a parameter $Acq_{i,k}$ can be involved in the definition of one or several objective functions. For simplicity, the remaining description will associate only one objective function per $Acq_{i,k}$ but the overall description can be easily extended to multiple objective functions.

$C_{i,k}(\ )$ are scalar functions. Generally, objective (or cost) functions are designed so that the optimum solution(s) minimize(s) its value. It should be noted that the objective functions may only require a limited number of parameters to be fully described. In the description below, $C_{k,i}(\ )$ will indifferently refer to the function itself or to the parameters describing it. Examples of objective functions will be presented in the discussion below.

$TAP_{i,k}$ is defined as the set of targets and constraints on the acquisition parameters $\{Acq_{i,k}\}$ or equivalently to $\{C_{i,k}(\ )\}$ within the time segment $S_{i,k}$. Each node is assumed to have an a priori complete or partial knowledge of the TAP. In some embodiments, the TAP parameters can be pre-loaded in the nodes' memory (e.g., memory 224) prior to the system deployment. Alternatively, the TAP parameters can be transmitted and/or updated during the course of the job through side information or dedicated messages. In such embodiments, the transmitted parameters can be limited to parameters which describe the cost function $C_{i,k}(\ )$. The ability to calculate the cost function $C_{i,k}(\ )$ at node level using the actual data produced downhole can significantly improve the system performance.

The System Operating Envelope 404

The System Operating Envelope (SOE) 404 is an intrinsic characteristic of the network 200 and generally can be viewed as a set of constraints that describe system limitations in terms of data transmission and acquisition. As an illustrative example, the set of constraints can include the network protocol and the data rate between nodes. The network protocol can include a definition of the network topology and the routing function, and a definition of the message and its size (e.g., a message can include an overhead (i.e., network routing information, protocol header, application specific information, etc.) and a bit budget for AData, as examples).

As mentioned above, the SOE 404 is an intrinsic characteristic of the network 200 and, thus, generally will not depend on the user. However, it should be noted that the user can have a level of choice in terms of the constraints on system performance. For example, the routing function and the choice of data rate between nodes could result from a network discovery. The user can have several options regarding the manner in which the network discovery process is performed.

Each node is assumed to have an a priori complete or partial knowledge of the SOE 404. For example, the routing function, the message definition and the data rate between nodes will usually be known by all the nodes since this information is needed to define the route of the messages throughout a DAC. However, a priori knowledge of the routing function may not be complete. For example, depending on the implementation, the routing can be a dynamic process and the routing function can change over time as a result of network discovery phases.

The main parameters limiting data transmission thus are defined in the SOE 404. Because the ability to match the user's acquisition needs is limited by the network performance, embodiments described herein optimize the series of actions performed during a DAC to best fit the user needs, taking into consideration the performance limitations. The parameters for optimization can include (without limitation) (1) the selection of the target data channels (and subsequently of the associated nodes) for data acquisition and the routing of the DAC through the network; and (2) the selection of data and the processing that is performed at the node level.

With respect to selection of the target data channels and the associated nodes and the routing of the messages through the network, the user (through the TAP) may place a specific focus on particular data channels. This focus can dictate that the series of messages triggered by the DAC will have to be routed through a series of particular producer nodes. The routing of the series of messages triggered by the DAC through the network can be static (decided by the surface) or dynamic (evolving as the series of messages is progressing through the network). It should also be noted that the routing of messages is constrained by the network protocol implementation and by the routing function.

The data selection process at producer node level and the data acquisition at access node level also impact the DAC. Acquired data can include any data transmitted from the producer nodes to the access nodes and resulting from the selection and transformation of the downhole data $\{d_{i,u_i}\}$. A goal of the techniques described herein is to best match the user needs considering the system data transmission limitations and to generate a data stream that can be transmitted by the system. The determination of a best match is assisted by the observation that a user generally will not need to receive the same data as produced downhole. Therefore, satisfying the user need may involve transforming the data at node level through a transform function $TF_D(\ )$, where $TF_D(\ )$ is applied on a selected set of data $\{d_{i,u_i}\}$. The $TF_D(\{d_{i,u_i}\})$ will result in a data stream to be concatenated in the out-going data stream $(AData)_{out}$.

It should be noted that upon reception at access node level, the received data stream may need to be transformed again through a transform function TFs( ). For example, the additional transform may be needed to place the data in a particular format so that the user interface 114 can store and/or display the acquired data. When an additional transform is used, the transformation will result in a set of acquired data $\{d_{i,u_i}*\}$, where:

$$\{d_{i,u_i}*\}=TF_S(TF_D(\{d_{i,u_i}\}))$$

In the equation above, $\{d_{i,u_i}*\}$ is the result of a transform of $\{d_{i,u_i}\}$ through TFs( ) and $TF_D(\ )$. Therefore, $\{d_{i,u_i}*\}$ (the data set at the access node) can be different from $\{d_{i,u_i}\}$ (the selected data set at the producer node), and:

$\{d_{i,u_i}\}_N$ represents the data selected at the producer node level at the execution of $DAC_N$.

$\{d_{i,u_i}*\}_N$ represents the data acquired at the access node as the result of the selection of $\{d_{i,u_i}\}_N$.

It should be noted that the transform $TF_D(\ )$ applied at the producer node level may not be a unique transform. In certain embodiments, there may be several $\{(TF_D(\ );\ TF_S(\ ))\}$ options available, and the determination of which to select can be made at the producer node level. For example, data can be compressed using a variety of different methods. The optimal data compression technique at any given time may be different than at other times. The process for the selection of the transform option will be discussed in further detail below.

The Use of Acknowledgements (ACK)

As discussed above, ACKs can be used by the scheduler 406 to manage access to the communication channel. However, the ability to acknowledge the completion of a DAC also can contribute to the optimization of the data acquisition process. To that end, once $DAC_N$ is completed, an $ACK_N$ addressed to the downhole communication nodes can be generated. As an example, $ACK_N$ can be propagated to the network in the next $DAC_N+1$. The $ACK_N$ message thus will inform the producer nodes of the data that already has been acquired at the surface. In some implementations, with such a mechanism in place, the $ACK_N$ would confirm to the producer nodes that the data $\{d_{i,u_i}*\}_N$ they selected has been acquired by the targeted access node. Knowledge of which data already has been acquired can assist with optimizing selection of a further data set to send to the access nodes.

The AAP vs. the TAP

Embodiments disclosed herein also monitor an Actual Acquisition Program (AAP) relative to the TAP 400. As set out above, the TAP 400 is defined by a set of acquisition parameters $\{Acq_{i,k}\}$ and cost functions $\{C_{i,k}(\ )\}$ quantifying the user needs in terms of data acquisition. The AAP is composed of all the possible best estimations of the $\{Acq_{i,k}\}$ at the current time and based on all the available information at that time. It should be noted that the ability to estimate the $\{Acq_{i,k}\}$ may depend on time and location. As an example, it may not be possible to estimate some of the acquisition parameters at access node level, while it may be possible to estimate the parameters at the producer node level, and vice versa. In such a case, some of the acquisition parameters can be estimated at the node level that has the best information for providing the best estimate and then passing the estimations on to other nodes as part of a DAC.

From the foregoing discussion, it can be seen that the decision process in terms of defining the sequence of DACs and of selecting and transforming the data is based on a set of contradictory requirements between the TAP 404 and the SOE 404. However, it is not necessarily optimal to make all acquisition decisions at the access node level. This is because an access node may only have a limited set of information regarding the data that has been produced downhole (e.g., the access nodes' knowledge is limited to the data already sent to the surface).

The amount of information available to make acquisition decisions will vary over time and will vary from node to node. Therefore, in embodiments, the acquisition process is an adaptive process where decisions are made dynamically during performance of a DAC at either the access node level or the producer node level. By enabling the producer nodes to make decisions during a DAC, the most relevant information can be used to optimize the acquisition process so that the actual data acquired can be best fit to the target acquisition needs.

In embodiments disclosed herein, decisions related to the data acquisition process that are made at the node level include (1) data selection and data transform selection; and (2) selection of the next nodes to be targeted by the DAC.

Decisions made at the node level are based on the information known locally $(Know)_{i,N}$ at the time $DAC_N$ reaches node i. At the level of a data producer i, the information available could include knowledge of all or a portion of the TAP; all or a portion of the SOE; the set of produced data $\{d_{i,u_i}\}$; the data from node i already processed $\{\{d_{i,u_i}\}_n\}_{n=1:N-1}$ for data transmission; the data from node i already acquired at surface $\{d_{i,u_i}*\}_{i=1:I,n=1:N-1}$ (which can be confirmed by use of the ACK); any information exchanged between the nodes through the DAC or any other communication session; and any digital information that is locally accessible by the node.

At the level of an access node, the information available can include knowledge of all or a portion of the TAP; all or a portion of the SOE; the data set already acquired $\{d_{i,u_i}*\}_{i=1:I,n=1:N-1}$ at surface from all the channels $\{D_i\}_{i=1:I}$; any information exchanged between the nodes through the DAC or any other communication session; and any digital information locally accessible by the node. It should be noted that access nodes do not have knowledge of the full set of produced data $\{d_{i,u_i}\}$. This knowledge is only available at the level of the data producer.

Regardless of whether the decision-making is performed at the access node level or the producer node level, the decision-making is a forward-looking prediction that is performed using the information that is locally available, where:

$$(\widehat{AAP})_{i,N} = \{\{\widehat{Acq}\}_N; \{\hat{C}\}_N\}$$

corresponds to the forward-looking prediction of the AAP.

In general, the forward-looking decision-making process involves the consideration of different options, ranking the options, and then selecting an option in accordance with the best ranking. The forward-looking prediction performed by a node uses the node's local knowledge $(Know)_{i,N}$ on a set of selected data $\{d_{i,u_i}\}$ and with a selected transformation $(TF_D(\ );\ TF_S(\ ))$ and with a target next node $D_j$. In various embodiments, $(\widehat{AAP})_{i,N}$ will not cover all the parameters listed in the AAP since the information available at node level will not be sufficient to do so. Further details on forward-looking methods will be provided below in the way of practical examples.

In summary:

$$(\widehat{AAP})_{i,N} = f_{i,n}(\{d_{i,u_i}\};(TF_D(\ );TF_S(\ ));Dj)$$

$(\{d_{i,u_i}\};\ (TF_D(\ );\ TF_S(\ ));\ Dj)$=argmin $f_{i,n}$ given $(Know)_{i,N}$ The independent variables for the optimization process can include (1) the selected data set $\{d_{i,u_i}\}$ within $\{d_i*\}$; (2) the selected transform $(TF_D(\ );\ TF_S(\ ))$ within $\{(TF_D(\ );\ TF_S(\ ))\}$; and (3) the selected next data stream within all the data streams $\{D_j\}_{j\neq i}$ except i.

In various implementations, an optimization variable also can be introduced:

$$e = (\{d_i\};\ (TF_D(\ );\ TF_S(\ ));\ D_j) \text{ with } (\widehat{AAP})_{i,N} = f_{i,n}(e)$$

The design space for optimization E is defined as:

$$E = \{\{d_i\};\ \{(TF_D(\ );\ TF_S(\ ))\};\ \{D_j\}_{j\neq i}\}$$

Constraints $E_{cons}$ can also be added to E. By adding constraints, it may be possible to reduce the size of the design space E and thereby accelerate the search for an optimum. Examples of possible constraints include:

- $\{d_i\}$ can be limited to the data that has not yet been transmitted $\{d_i\}\backslash\{\{d_{i,u_i}\}_n^S\}_{n=1:N}$
- some of the acquisition targets can also be expressed in terms of constraints on the $\{d_i\}$
- $\{D_j\}_{j\neq i}$ can be limited to the nodes that have not been interrogated by $DAC_N$ at the time it is processed by node i Once the design space E is defined, the decision-making process becomes a multi-objective optimization (MOO) problem:

$$\underset{E\backslash E_{cons}}{\text{Min}}\ F(e) = [\hat{C}_{i,k}(e)]^T$$

with the implicit constraint that objective functions can be estimated locally with the available knowledge $(Know)_{i,N}$ at node i at the time of $DAC_N$.

The data acquisition techniques described above can be implemented as instructions of software that are executed by a processing system that has sufficient processing power and memory to performs the functions set out above. The processing system can be located in one or more of the processing nodes, access nodes, user interface 142, or surface system 112 as would be appropriate for the particular application in which the techniques are implemented. Further, although the embodiments have been discussed with reference to acoustic modems deployed in a wellbore, it should be understood that the data acquisition techniques and arrangements disclosed herein are not limited to acoustic networks, but can be employed in any wireless environment. Further, although the environments described herein have been in the context of a telemetry network deployed in a wellbore, the techniques and arrangements are applicable in other contexts where network constraints limit the amount of information that can be transmitted.

Exemplary Implementation 1:

The following description illustrates an exemplary implementation of the techniques and systems described above in the context of downhole data selection optimization as a function of user needs.

This exemplary implementation relies on the implementation of wavelet data compression coupled with progressive coding. The example described below will be limited to a single data producing node in order to simplify the overall description. However, it can be readily extended to multiple nodes.

In this example, the producer node performs a progressive encoding of the original data set gathered by the producer. A wavelet transform is applied for data conditioning prior to data selection and data transmission. The wavelet transform requires a data producer Y, a series of data acquisition segments $[S_k]_{k=1:K}$, and a wavelets decomposition base $\{\Psi_{m,p}\}$ associated with each time segment. It is assumed that the wavelet base is the same for each time segment in order to simplify the description. However, the concept can be extended to more complex cases.

It should be reminded that the wavelet analysis relies on the time extension/contraction of the base function while keeping its shape unchanged. "m" is the index linked to the binary dilatation while "p" is the index linked to the binary position. Depending on its binary dilatation, each $\Psi_{m,p}$ is implicitly linked to a frequency band $\Delta f_m$.

The data Y are segmented as per the acquisition segments $S_k$ and projected on the wavelets base on each segment $S_k$, leading to a series of wavelet coefficients $\{W_{m,p,k}\}$.

In the context of this example, the wavelet coefficients are used for the purpose of transmitting the data to one of the access nodes. The data Y within each time segment $S_k$ can be reconstructed at surface using the wavelet coefficients $\{W_{m,p,k}\}$. A partial reconstruction can be done at surface if the wavelet coefficients are partially transmitted to surface. The set of wavelet coefficients can be partially transmitted by quantization of some of the coefficients or by omission of some of the coefficients.

For consistency with the description of the invention provided earlier, in this example, the data that is considered for transmission corresponds to the wavelet coefficients, so that:

$$\{d_i\} \rightarrow \{W_{m,p,k}\}.$$

The data selection will be performed on the wavelet coefficients, as will be explained below. The data acquired at the access node level after data transmission will be:

$$\{d_i^*\} \rightarrow \{W_{m,p,k}^*\}$$

where $W_{m,p,k}^*$ are the wavelet coefficients acquired after the data selection process and its transmission through the network.

In the context of this specific implementation, the wavelet coefficients are encoded into bits. For purposes of illustration, the description will be based on a binary integer representation.

$$\{W_{m,p,k}\} \rightarrow \{I_{m,p,k}\}$$

where $\{I_{m,p,k}\}$ is the integer representation of $\{W_{m,p,k}\}$. The integer representation $\{I_{m,p,k}\}$ can be segmented in bit planes from its most significant bit to the least significant one:

$$\{W_{m,p,k}\} \rightarrow \{P_{m,p,k,s}\}$$

where $P_{k,s}$ is the $s^{th}$ bit plane associated with the $\{W_{m,p,k}\}$ coefficients.

As discussed above, when data production is higher than the system communication capability, the data to be transmitted to the access nodes has to be selected. In this example, the bits-planes representation can be used for data selection. It ranks the data from MSB (Most Significant Bit) to LSB (Least Significant Bit), and the system is designed to focus on the transmission of the most significant bits first. As such, the bit-planes representation of the data is used to define a data transform that then is used for data selection and transmission:

$$W_{m,p,k}^* = \sum_{s \in O_k} P_{m,p,k,s} * 2^s$$

where $O_k$=subset of $P_{m,p,k,s}$ selected for data transmission. A more detailed overview of the actual implementation will be given below.

In this example, the user defines a TAP using a maximum target reconstruction error that can be time and frequency dependent in order to select the data to be transmitted. In accordance with this technique, the error of reconstruction of one data sample is the difference between the acquired data and the original memory data in the measurement node. For the example described here, the TAP objectives are defined based on reconstruction of the wavelet coefficients. To that end:

$$\{Acq_k\} \rightarrow \{W_{m,p,k}\}.$$

The MSE (Mean Square Error) can be used to quantify the reconstruction error, where MSE(m,k) represents a reconstruction error on the wavelet coefficients over time segment $S_k$ and within the frequency band $\Delta f_m$:

$$MSE(m, k) = \sum_p (W_{m,p,k} - W_{m,p,k}^*)^2$$

The TAP is defined as a maximum MSE per frequency band $\Delta f_m$ and time segment $S_k$:

$$MSE_Max(m,k)$$

The cost function is defined as:

$$C[m,k] = MSE[m,k] - MSE_MAX[m,k]$$

As long as C[m,k] is positive, the objective has not been met on the time segment k and the frequency band $\Delta f_m$.

The user can input the TAP through the user interface. The TAP can be entered once at the beginning of the operation and it can also be updated during the operation.

Data selection is performed at the node level through the wavelet coefficients. To that end, the wavelet transform performs a time-frequency decomposition of the data. The selective transmission of the wavelet coefficients enables a partial reconstruction of the signal to be generated based on the data transmitted to surface.

The data selection is achieved through Multi-Objectives Optimization (MOO). In this example, the data selection is performed using the bit-planes representation $\{P_{m,p,k,s}\}$ of the wavelet coefficients. And, the following cost function is used:

$$\text{Distortion}() = \sum_k \sum_m C[m, k]$$

The design space for optimization is defined through the bit-plane representation of the wavelet coefficients, restrained to the ones that remain to be transmitted:

$$E=\{P_{m,p,k,s}\}/\{O_k\}/\text{SOE}$$

The selection of the data to be transmitted is done through the minimization of Distortion( ):

$$D_T = \underset{E}{\text{argmin}}\{\text{Distortion}()\}$$

It should be noted that E is of finite size (limited number of combinations). Therefore a solution to solve the problem is to calculate the distortion for all combinations and pick the combination $D_T$ that minimizes the distortion. Other techniques may include Lagrangian multipliers or gradient methods. The selection of the optimization method will be application dependent.

The data selection is an iterative process that is driven by the data production. It can be updated every time a new data segment $S_k$ has been generated. $\{D_T\}_k$ represents the ensemble of the data selected for transmission upon the processing of data from segment $S_k$ and that have not been sent to surface yet.

Figure 7:
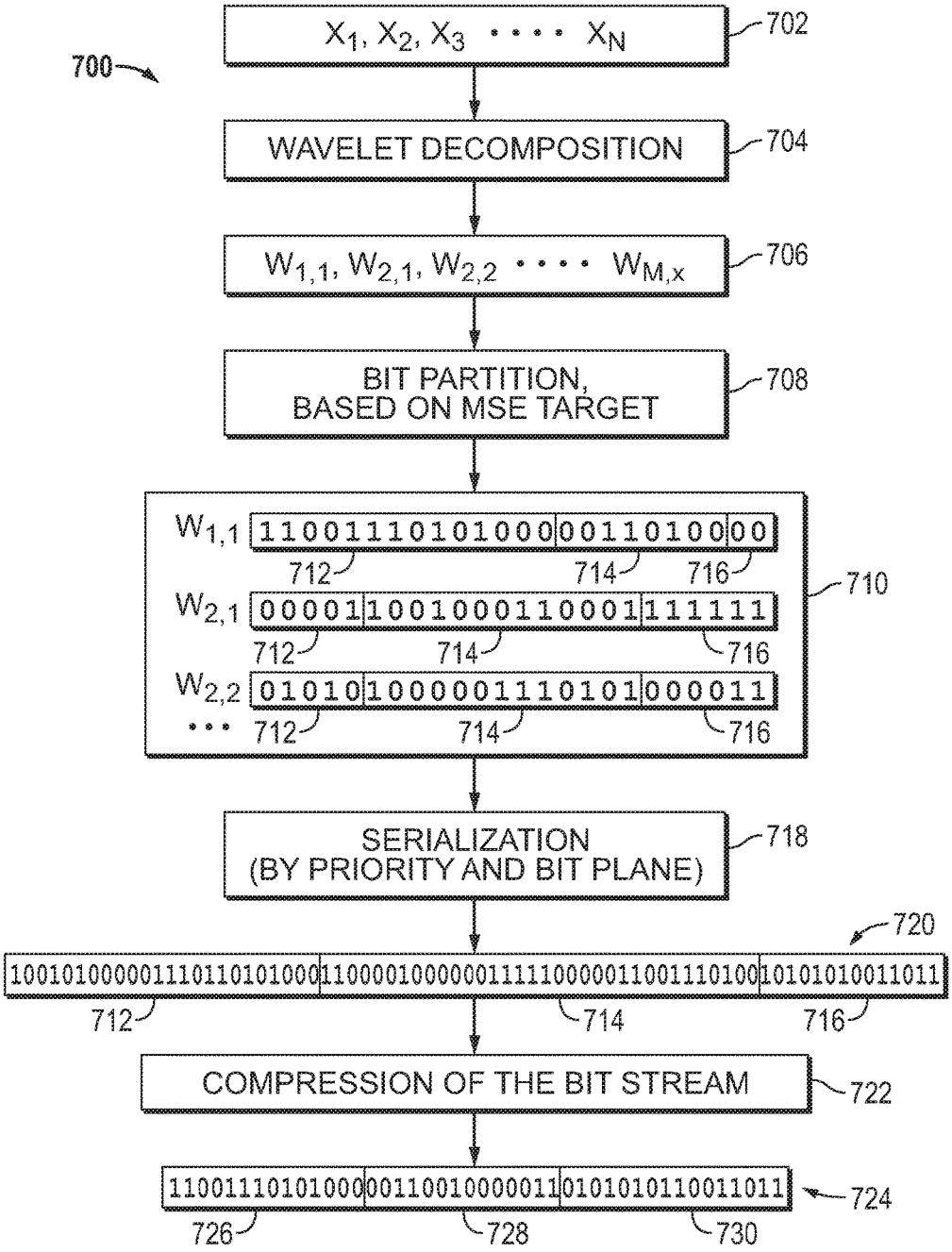
FIG. 7 is a workflow diagram illustrating an implementation of progressive coding to acquire data from a communication node, according to an embodiment.

Another feature of this example implementation is progressive coding. The selected wavelet coefficients are transformed in a bit stream, using a progressive method. FIG. 7 illustrates an example progressive coding workflow 700 that is performed on raw samples "$x_1$, $x_2$, $x_3$ . . . $x_N$" of the raw data set 702. In accordance with this method, a wavelet decomposition (block 704) is implemented on the raw samples 702 to produce a set of wavelet coefficients 706 ($W_{1,1}$, $W_{2,1}$, $W_{2,2}$ . . . $W_{M,x}$). The bit-plane representations of the selected wavelet coefficients $\{D_T\}$ are partitioned into groups depending on the target MSE_MAX[m,k] specified by the user (block 708), thereby generating partitioned coefficients 710. As shown in the example of FIG. 7, each of the coefficients 706 is partitioned into three groups or blocks 712, 714, 716. The partitioning depends only on the selected data (and the associated MSE_MAX, specified by the user). As a consequence, both the user and the producer node are aligned on the partitioning.

In the example, the MSE_MAX is defined for the low frequency $W_{1,1}$ and high frequency ($W_{2,1}$ and $W_{2,2}$). As stated before, the MSE can be associated with a bit plane. As an example, the MSE_MAX can be 3 for the low frequency component and 10 for the high frequency. The partitioning is done so that only certain of the bits need to be transmitted to meet the target. In this example, only the bits in groups 712 and 714 need to be transmitted to meet the target.

Next, in this example, the bits with similar importance (e.g., that are in the same groups) are concatenated to form a bit stream 720 that represents the data to be sent to surface (block 718). The bit stream can be compressed using traditional coding techniques (block 722) to generate a compressed bit stream 724 with compressed groups 726, 728, 730 that correspond to groups 712, 714, 716, respectively. The bit stream 724 is stored in the memory of the producer node. The bit stream 724 then is ready to be transmitted. Upon reception of a query $DAC_N$, the producer node can then progressively transmit the bit stream 724, starting with the compressed group 726 and then progressing to the group 728 and then the group 730.

To summarize, in this example, the following flow of operations is performed sequentially in the producer node: (1) the real-time data is buffered till the end of the time window $S_k$ corresponding to the encoding packet duration; (2) the buffered data is transformed with a wavelet decomposition; (3) the wavelet decomposition provides a set of coefficients $\{W_{m,p,k}\}$, which discretize the signal information in time and in frequency; and (4) the wavelet coefficients $\{W_{m,p,k}\}$ are discretized and segmented in bit planes:

$$\{W_{m,p,k}\} \rightarrow \{I_{m,p,k}\} \rightarrow \{P_{m,p,k,s}\}$$

Upon reception of a $DAC_N$ targeting the producer node, the node performs data selection through MOO and using Distortion( ) as a cost function:

$$D_T = \underset{E}{\text{argmin}}\{\text{Distortion}()\}$$

Upon selection $D_T$ through MOO, $D_T$ will be sent to the access node in response to the DAC. Then the selected data will be taken from the progressive bit stream resulting from the data selection process and aggregated to the DAC Data Flow $[\text{AData}]_N$. As a result, it will be sent to the access node in response to $DAC_N$. Upon reception and demodulation of the $DAC_N$ response, the transmitted data is acquired by the access node:

$$\{d_i^*\}N=D_T$$

Overall, from the surface, it results in a set of acquired wavelet coefficients:

$$\{d_i^*\} \rightarrow \{W_{m,p,k}^*\}$$

In this example, it is assumed that there is no loss of information from the initial raw data to the blocks of bit streams. Consequently, the set of bit streams associated with one time segment is equivalent to $\{d\}_k$.

As a side feature of this example, it is assumed that a DAC is started periodically. The downlink queries aim at (1) acknowledging the successful reception of the previous uplink messages; (2) transmitting the updated TAP from the user to the producer node; and (3) transmitting some information on the DAC, such as the bit budget per message and the number of uplink messages to send from the producer node.

Recall that the $\{W_{m,p,k}\}$ results from the transformation of an original data flow Y. Therefore, the acquired coefficients $\{W_{m,p,k}^*\}$ can be used to reconstruct Y at the level of the access nodes.

$$Y^* = \sum_{m,p,k} W_{m,p,k}^* \Psi_{m,p}$$

Exemplary Implementation 2:

In this example implementation, DACs are initiated from the surface at a regular frequency set by the user, every 5 minutes for example. In other implementations, DACs can be initiated at arbitrary intervals in an automated way (the density of DACs could vary over time depending on how challenging the TAP is relative to the SOE).

A DAC can be addressed to one or several producer nodes. It can be composed of one or several responses, which can be sent consecutively by different nodes, or which can combine data of several nodes.

At time N, a large number of possible DACs can be triggered. The optimum $DAC_N$ is picked by minimizing the prediction of one or several cost functions when $DAC_N$ is completed. A definition of the cost function and a solution to the minimization problem are addressed in this implementation.

When $DAC_N$ needs to be triggered, a decision is made regarding this DAC. There is a space, E, of possible decisions regarding $DAC_N$. A decision can address the following issues: (1) What are the nodes addressed by the DAC?; (2) How are the nodes addressed by the DAC?; (3) How is the bit budget split between the nodes? (A decision defines a breakdown of the bit budget).

The Bit Budget (BB) is the maximal number of bits that can be retrieved per DAC response. In this example implementation, the bit budget is constant to a nominal value, for example 300 bits. The Bit Budget is part of the System Operating Envelope (SOE). For example, a decision regarding the DAC can be: (1) Address nodes 1, 2, 3; (2) Response 1: data of node 1 (50% of BB) and node 2 (50% of BB); and (3) Response 2: data of node 3 (100% of BB).

In general, E is a space of infinite size. In some implementations, E can be made finite by reducing it to a certain number of elements (decisions), which can be, for example:

- Address one node and send 1, 2 or 3 responses
- Address two nodes and send 1, 2 or 3 responses per node
- Address two nodes and send 1 combined response with shared BB
- Address three nodes and send 1, 2 or 3 responses per node
- Address three nodes and send 1 combined response with shared BB In the example above, the number of elements in E would be:

$$\binom{M}{1}\times 3+\binom{M}{2}\times 3+\binom{M}{2}\times 1+\binom{M}{3}\times 3+\binom{M}{3}\times 1$$

where M is the number of measurement nodes.

In this implementation, E is a finite space which is noted $E=\{E_j, j=1 \ldots J\}$. The user defines the TAP by setting constraints on acquisition parameters $\{Acq_i\}$ which can be, for example:

- Sampling interval $\Delta_i$
- Maximum acquisition lag time $L_i$. The lag time is defined as the difference between the current time and the last acquired data: $L_i(t)=t-t_i(t)$.
- A flag of priority that identifies critical nodes: Low/Medium/High or Must Have (MH).

This example implementation is based on multi-node lag time optimization. The relative lag time is defined as the difference between the current and maximum acquisition lag times:

$$\Delta L_i=L_i(t)-L_i$$

This number will be non-positive (≤0) if the channel is "on time" and positive (>0) if the channel is "late".

The bit cost per sample $BC_i$ is the average number of bits required to encode a data sample of channel i in a wireless message. $BC_i$ is a function of time. In this example the optimization (choice of the "best" element in E, i.e., the element which minimizes a certain cost function) is performed in three steps:

1. Estimate the bit cost per sample $\widehat{BC_i}$ per measurement node, based on the data $\{d_{i,u_i}*\}_{N-1}$ acquired at surface at that stage. For example, the estimation can consist of computing the compression ratio on a series of past responses.
2. Based on the previous estimations, for each decision $E_j$, predict the relative lag times for all the nodes (forward-looking prediction) when $DAC_N$ is completed:

$$\widehat{\Delta L_i}\,|E_j=(t-t_i(t)-L_i)|E_j$$

$$=(t+\text{duration}_{DAC}(E_j))-\left(t_i(t)+\Delta_i\frac{BB_i(E_j)}{\widehat{BC_i}}\right)-L_i$$

where $BB_i(E_j)$ is the total bit budget allocated to channel i in scenario $E_j$. The expected duration of $DAC_N$ can be calculated deterministically depending on $E_j$.

3. Search for the optimal decision $E_o$ by minimizing a cost function calculated from $\{\widehat{\Delta L_i}\,|E_j\}$.

$\{\widehat{\Delta L_i}\,|E_j\}$ can be seen as a matrix whose rows are measurement nodes/channels and columns, decisions. The search of the optimum decision $E_o$ is a multi-objective optimization problem which can be solved as follows:

1. Find the set of decisions $E_{o1}$ that satisfies $\widehat{\Delta L_i}\leq 0\forall i$ (all nodes are "on time").
2. If $E_{o1}$ exists, select the $E_o\in E_{o1}$ which minimizes $$\hat{C}=\sum_{i=1}^{M}\left(\widehat{\Delta L_i}-\frac{1}{M}\sum_{i=1}^{M}\widehat{\Delta L_i}\right)^2.$$

Minimizing the variance guarantees that the lag times are consistent between the measurement nodes. When optimization is done, trigger $E_o$.

3. If $E_{o1}$ does not exist, restrict the search on the Must Have (MH) nodes: find the set of decisions $E_{o2}$ that satisfies $\widehat{\Delta L_i}\leq 0\forall i\in MH$ (all MH nodes are "on time").
4. If $E_{o2}$ exists, select the $E_o\in E_{o2}$ which minimizes $\hat{C}$. When optimization is done, trigger $E_o$.
5. If $E_{o2}$ does not exist, focus on the Must Have nodes: select the $E_o$ which minimizes $$\hat{C}_{MH}=\sum_{MH}\left(\widehat{\Delta L_i}-\frac{1}{NMH}\sum_{MH}\widehat{\Delta L_i}\right)^2.$$

When optimization is done, trigger $E_o$.

In this example implementation, the decision process in terms of defining the sequence of DACs is shared between access and producer nodes: data selection ($\{d_{i,u_i}\}$), node selection $$(\{D_j\}_{j\neq i})$$

and DAC routing are performed at access node level as described above whereas data processing ($\{(TF_D(\ );\ TF_S(\ ))\}$) is performed at the producer node level.

In this example implementation, the cost function is defined as the variance of the relative lag times of the measurement nodes. Other implementations can use other definitions of the cost function.

Exemplary Implementation 3:

This section illustrates another example implementation that uses an advanced scheduling and query building algorithm. As set out before, the user can define the TAP through the user interface. The access to the network is done through the scheduler (e.g., scheduler 406).

The scheduler 406 controls the access of the DAC to the network. The scheduler 406 includes a stack 418 of DACs defined by the Queries Builder 416. The definition and management of the stack 418 is performed by the Queries Builder 416. It is a dynamic process and the order of the priority can be updated at any time by the Queries Builder 416.

Recall that the DAC can be addressed to one or several data channels and nodes. The example implementation described below will be limited to a DAC addressed to a single node.

The most intuitive solution to manage the stack priority could be based on a FIFO policy (First In First Out) or also called FCFS (First Come First Served). But in practice, some data channels could have higher priority. For example, data from certain sensors may be of greater interest than other data. In this example implementation, an advanced and sophisticated method, taking into account the targets and constraints set by the acquisition parameters, is disclosed.

According to the TAP, the DACs are initiated from the surface at a regular frequency set by the user, for example every four minutes. However, due to the limitations of the communication network in terms of throughput and Round Trip Time (RTT) (as defined by the SOE), the DAC frequency is specified in the TAP. Thus, a multiple queues system (for the different data channels) can be considered in the scheduling scheme.

To match the AAP to the TAP, this example implementation implements a Priority Based Advanced Highest Lag Time First scheduling algorithm (P-AHLTF), which is composed of two steps. The first step is to request dispatching according to the weighted average of the actual lag time and relative queue length of producer nodes. The second step is to request selecting according to the priority of requests.

To be adaptive and flexible, the algorithm is applied each time a DAC is completed and a new one is initiated. For the remainder of this example, the following parameters apply:

- There are n communication nodes belonging to the acquisition program, where the i-th node is denoted by GNi ($1<i<n$).
- The communication nodes are ranked with a unique rank representing the priority $P_i$ where P varies from 1 to n (the higher the value of P, the greater the priority).
- Each node i might produce several types of data $[D_i]$, it might be advantageous to consider the different data channels of the same node 1 as independent data channels.
- Each node has an internal queue, with the capacity of $Nbuffer_i$
- Each node i has a set of data channels $K_i$, with an actual Lag Time $L_{k,i}$, where $L_{k,i}$ represents for each data channel the lag time between the latest acquired data and the current time.

The P-AHLTF algorithm is divided into two steps:

1. Request dispatching according to the weighted average of the Relative Queue Length (RQL) and Current Lag Time (CLT).
2. Priority based request selecting, based on the priority attributed to the communication node.

In the request dispatching step, all the requests added to the internal queues of each node will be treated according to the dispatching policy. Many dispatching algorithms are known, such as the Random Selection algorithm (RS), the Shortest Queue First algorithm, and the Highest Lagging Time First (HLTF). The HLTF algorithm is used in this example. The HLTF algorithm is the request dispatching step of the P-AHLTF algorithm. The HLTF algorithm makes its dispatching decision according to the Request Selection Factor (RSF) which is a weighted average of the Relative Queue Length (RLQ) and the Current Lag Time of a given channel in a given communication node (CLT).

The following definitions apply in this example:

Definition 1: The Relative Queue Length (RQL) of a given node is the quotient of the length of the current waiting requests and the capacity of the queue.

The RQL of the i-th node is RQL(i)=

$$\frac{M_i}{Nbuffer_i}$$

where M is the current size of the queue and Nbuffer is the maximum size of the queue.

Definition 2: The current Lag Time of a given data channel k among a node i, is the time difference between the current time t and the latest acquired data $t_i(t)$:

$$L_{i,k}=t-t_{i,k}(t)$$

Definition 3: The Request Selection Factor (RSF) of a given node is the weighted average of the RLQ and CLT ($L_{k,i}$).

Given the weight of the RLQ and CLT is $w_1$ and $w_2$ respectively, and $w_1+w_2=1$, the RSF of the channel k of the node i is $$\mathrm{RSF}(k,i)=w_1*\mathrm{CLT}(k,i)+w_2*\mathrm{RLQ}(i)$$

The weights $w_1$ and $w_2$ are selected by the user, depending on the importance accorded to the parameters RLQ and CLT.

The strategy of the AHLTF request-dispatching policy is applied to each node. At the end of the DAC only one request is selected from each internal queue of the nodes, maximizing the cost function RSF. The selected request $sq_k$ $$\text{for the node } i \Rightarrow \underset{q_{k,i}}{\operatorname{argmax}}\{RSF(k,i)\}:$$

$$sq_k(i)=\{k|\mathrm{RSF}(k)=\max(\mathrm{RSF}(1,i),\mathrm{RSF}(2,i),\mathrm{RSF}(3,i),\ldots,\mathrm{RSF}(M,i))\}$$

At the end of the Request Dispatching step, a pool of maximum 'n' requests, from all the communication nodes belonging to the TAP, is created. Then, a second round of ranking of the queries is done maximizing the cost function RSF. The telemetry network follows a Master/Slave architecture, only one query is executed every DAC, the request with the highest RSF from the requests pool is selected to be executed.

In case the optimization problem has more than one query maximizing (having the same cost function RSF), a second policy called Node-Priority-Selecting policy is applied. In accordance with this policy, as part of the preparation and design of the TAP, the user selects a set of communication nodes to be part of the program. Once the program is set, the user assigns a unique priority value to all the nodes. For a program with 'n' nodes, each node i is assigned a unique priority level $P_i$, where the level of priority ranges from [1 to N].

At the end of the Request-Dispatching Policy, in case more than one request from different nodes have been selected, only the request coming from the highest priority node is selected to be executed by the Scheduler.

$$\text{Selected request } sq_{k,i} \text{ from the node } i \Rightarrow \underset{i}{\operatorname{argmax}}\{P(i)\}$$

The flow of the example algorithm is described below:

n: Total selected communication nodes for the acquisition program TAP $Nbuffer_i$: The maximum queue size of the internal queue of the node i $M_i$: Current size of the internal queue of the node i $K_1$: Total number of data channels belonging to the node i.

P(i): Each communication node has a unique priority level $w_1$, $w_2$: Weights set by the user $L_{k,i}$: Lag Time of the data channel k belonging to the node i RLQ(i): the current relative queue length of the node i.

At the end of the current DAC

Do:

1: request dispatching policy

2: request pool initialization G{ }←empty

3: for each node i

4: update RLQ(i)

$$= \frac{M_i}{nbuffer_i}$$

5: for each data channel k

6: update $L_{k,i}=t-t_{k,i}(t)$

7: $RSF_{k,i}=w_1*L_{k,i}+w_2*RLQ(i)$

8: end $$9\text{: Select the request } sq_i \underset{k}{\leftarrow} \operatorname{argmax}(RSF_{k,i})$$

10: G{ } add $sq_i$

11: end

12: rank the requests in G{ } according to RSF,

13: if (only one query with max RSF)

14: execute selected query $sq_j$ belonging to the node j

15: else

16: node priority selecting policy

17: select the query $sq_i$ with the highest RSF and from node i with $$18\text{: } sq_i \underset{i}{\leftarrow} \operatorname{argmax}(P(i))$$

19: end

Although the preceding description has been described herein with reference to particular means, materials and embodiments, it is not intended to be limited to the particulars disclosed here; rather, it extends to all functionally equivalent structures, methods and uses, such as are within the scope of the appended claims.

What is claimed is:

1. A method of acquiring data in a wireless telemetry network that includes a plurality of wireless communication nodes in communication with a data acquisition system, the method comprising:

defining a target data set to acquire from a produced data set stored in a wireless communication node of the telemetry network, the produced data set corresponding to measurements of the parameter of interest;

providing a system operating envelope defining communication characteristics associated with the telemetry network; and initiating a data acquisition cycle to acquire an actual data set from the produced data set, wherein the data acquisition cycle includes execution parameters that are automatically optimized so that the actual data set is an optimal match of the target data set given the system operating envelope.

2. The method as recited in claim 1, wherein the communication characteristics vary over time, and the method comprises dynamically modifying the system operating envelope based on current communication characteristics of the telemetry network.

3. The method as recited in claim 2, wherein the communication characteristics include at least one of communication channel capacity and communication channel latency.

4. The method as recited in claim 1, further comprising initiating a sequence of data acquisition cycles, wherein the sequence is configured to progressively acquire optimal data sets based on the target data set, the system operating envelope, and a previous actual data set acquired by a previous data acquisition cycle in the sequence.

5. The method as recited in claim 1, wherein defining the target data set comprises specifying a desired quality of the actual data set relative to the produced data set, wherein the desired quality is at least one of a sampling rate, a data sample error, and an acquisition lag.

6. The method as recited in claim 1, wherein the execution parameters of the data acquisition cycle that are optimized include a routing of the data acquisition cycle through the telemetry network.

7. The method as recited in claim 1, wherein the execution parameters of the data acquisition cycle that are optimized include a selection of a type of data transformation to perform on the produced data set.

8. The method as recited in claim 7, wherein the data transformation comprises a wavelet decomposition.

9. The method as recited in claim 8, further comprising segmenting the produced data set into time segments, and applying the wavelet decomposition to each segment to generate a set of wavelet coefficients for each segment.

10. The method as recited in claim 9, further comprising encoding the wavelet coefficients into bits.

11. The method as recited in claim 10, further comprising classifying the bits according to a classification that ranges from most significant bits to least significant bits.

12. The method as recited in claim 11, further comprising selecting a subset of bits based on the classification, and transmitting the selected subset to the data acquisition system.

13. The method as recited in claim 12, further comprising estimating partial wavelet coefficients from the transmitted selected subset, and reconstructing the actual data set based on the partial wavelet coefficients.

14. The method as recited in claim 1, wherein at least a portion of the execution parameters are optimized by the wireless communication node that stores the produced data set.

15. The method as recited in claim 1, further comprising scheduling initiation of a next data acquisition cycle after receipt of an acknowledgement that a previous data acquisition cycle has completed.

16. A method of acquiring telemetry data in an acoustic communications network that includes a plurality of acoustic communication nodes deployed in a wellbore extending from a surface into a hydrocarbon-producing formation, comprising:

gathering, by a first acoustic communication node, a downhole data set corresponding to a measured parameter of interest;

defining a target data set desired at the surface, wherein the target data set is a subset of the downhole data set;

defining performance limitations of the acoustic communications network;

automatically optimizing acquisition of an actual data set from the downhole data set to transmit to the surface, wherein the actual data set is an optimal data set that best matches the target data set given the performance limitations of the acoustic communication network; and receiving the actual data set at the surface.

17. The method as recited in claim 16, wherein optimizing acquisition comprises selecting routing of a set of queries to propagate through the communication network to acquire the actual data set.

18. The method as recited in claim 16, wherein optimizing acquisition comprises selecting, by the first acoustic communication node, the actual data set from the downhole data set based on the target data set and the performance limitations of the acoustic communication network.

19. The method as recited in claim 18, wherein optimizing acquisition further comprises selecting, by the first acoustic communication node, a type of processing to perform on the downhole data set prior to transmission of the actual data set to the surface.

20. The method as recited in claim 19, wherein the processing comprises a wavelet decomposition applied to the downhole data set.

21. The method as recited in claim 19, wherein optimizing acquisition further comprises selecting, by the first acoustic communication node, a next node to receive the actual data set.

22. The method as recited in claim 18, wherein optimizing acquisition further comprises selecting, by the first acoustic communication node, the actual data set based on knowledge of a previous actual data set transmitted to the surface.

23. The method as recited in claim 22, wherein the knowledge is based on receipt by the first communication node of an acknowledgement that the previous actual data set was received at the surface.

24. A system for acquiring telemetry data from a communication network deployed in a wellbore, comprising:

a control and telemetry system located at a surface to control and monitor a downhole operation, the control and telemetry system including a user interface;

downhole equipment located in the wellbore to observe parameters of interest associated with the downhole operation; and a network of communication nodes coupled to an acoustic transmission medium at spaced apart locations extending between the control and telemetry system and the downhole equipment, wherein a first communication node is configured to gather a first downhole data set from the downhole equipment corresponding to an observed parameter of interest over time, a second communication node is configured to gather a second downhole data set from the downhole equipment corresponding to an observed parameter of interest over time, and a third communication node includes an interface to communicate with the user interface, and wherein the network has intrinsic data throughput limitations, wherein the user interface accepts inputs from a user to define a target data set desired from the first and second downhole data sets and to automatically build a set of queries to optimally acquire an actual data set that best satisfies the target data set given the intrinsic data throughput limitations of the network.

25. The system as recited in claim 24, further comprising a scheduler to initiate propagation of the set of queries through the network, wherein the set of queries enters the network through the third communication node.

26. The system as recited in claim 25, wherein the scheduler maintains the set of queries in a stack, and wherein the scheduler selects a query to dispatch from the stack based on respective lag times to acquire data from the first communication node and the second communication node.

27. The system as recited in claim 25, wherein the scheduler further selects the query to dispatch based on respective priority rankings assigned to the first and second communication nodes.

28. The system as recited in claim 24, wherein the first communication node receives a query from the set of queries and, in response, selects a method for processing the downhole data set to optimally match the actual data set to the target data set given the intrinsic throughput requirements of the network.

29. The system as recited in claim 28, wherein the method for processing comprises a wavelet decomposition.

* * * * *